US009175846B2

(12) United States Patent
Morin et al.

(10) Patent No.: US 9,175,846 B2
(45) Date of Patent: Nov. 3, 2015

(54) DOUBLE WALL EXTENSION

(75) Inventors: Jean-Xavier Morin, Neuville Aux Bois (FR); Daniel Baglione, Gentilly (FR)

(73) Assignee: ALSTOM Technology Ltd, Baden (CH)

( * ) Notice: Subject to any disclaimer, the term of this patent is extended or adjusted under 35 U.S.C. 154(b) by 686 days.

(21) Appl. No.: 11/918,293

(22) PCT Filed: Apr. 26, 2006

(86) PCT No.: PCT/FR2006/050389

§ 371 (c)(1),
(2), (4) Date: Oct. 11, 2007

(87) PCT Pub. No.: WO2006/114551

PCT Pub. Date: Nov. 2, 2006

(65) Prior Publication Data

US 2009/0084293 A1 Apr. 2, 2009

(30) Foreign Application Priority Data

Apr. 26, 2005 (FR) ..... 05 51070

(51) Int. Cl.

| | |
|---|---|
| ***F22B 23/00*** | (2006.01) |
| ***F22B 21/02*** | (2006.01) |
| ***F22B 21/34*** | (2006.01) |
| ***F22B 31/00*** | (2006.01) |
| ***F23C 10/18*** | (2006.01) |
| ***F23M 5/08*** | (2006.01) |

(52) U.S. Cl.

CPC ..... *F22B 21/02* (2013.01); *F22B 21/34* (2013.01); *F22B 31/0007* (2013.01); *F23C 10/18* (2013.01); *F23M 5/08* (2013.01)

(58) Field of Classification Search

CPC ..... F22B 23/00
USPC ..... 110/245; 432/58, 15; 122/40, 235.15
See application file for complete search history.

(56) References Cited

U.S. PATENT DOCUMENTS

| | | | | | |
|---|---|---|---|---|---|
| 2,072,535 | A | * | 3/1937 | Thomas | 196/110 |
| 3,130,714 | A | * | 4/1964 | Koel | 122/240.1 |
| 4,165,717 | A | * | 8/1979 | Reh et al. | 122/40 |
| 4,176,710 | A | * | 12/1979 | Gansauge et al. | 422/146 |
| 5,140,950 | A | * | 8/1992 | Abdulally | 122/4 D |
| 5,215,042 | A | * | 6/1993 | Beisswenger et al. | 122/4 D |

(Continued)

FOREIGN PATENT DOCUMENTS

| | | | | |
|---|---|---|---|---|
| FR | 2712378 | | 5/1995 | |
| FR | 2855593 | | 12/2004 | |
| GB | 1048832 | | 11/1966 | |
| WO | WO03081128 | * | 10/2003 | F23G 5/00 |

OTHER PUBLICATIONS

PCT International Search Report (PCT/FR2006/050389).

(Continued)

*Primary Examiner* — Alissa Tompkins
*Assistant Examiner* — John Bargero
(74) *Attorney, Agent, or Firm* — Robert D. Crawford

(57) ABSTRACT

The invention concerns a fluidized bed reactor (1) made up of tubed membrane walls (2) cooled by a coolant fluid, the said walls surrounding a combustion chamber (10) and comprising tubed extension panels (3) through which flows a coolant fluid by single pass forced circulation.

According to the invention the extension panels (3) are paired two by two.

20 Claims, 11 Drawing Sheets

(56) References Cited

U.S. PATENT DOCUMENTS

| | | | | |
|---|---|---|---|---|
| 5,299,532 | A * | 4/1994 | Dietz | 122/4 D |
| 5,678,497 | A * | 10/1997 | Goidich | 110/245 |
| 5,836,257 | A | 11/1998 | Belin et al. | |
| 5,979,367 | A * | 11/1999 | Aubry et al. | 122/4 D |
| 7,152,537 | B2 * | 12/2006 | Enault | 110/245 |
| 2006/0124077 | A1 * | 6/2006 | Weissinger et al. | 122/4 D |

OTHER PUBLICATIONS

Office action issued from European Patent Office dated Jul. 2, 2015 for EP Application No. 06743846.5.

* cited by examiner

FIGURE 5a
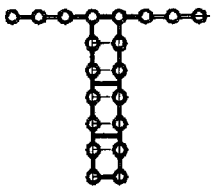
FIGURE 5b
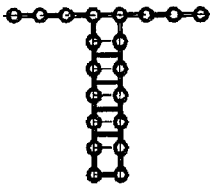
FIGURE 5c
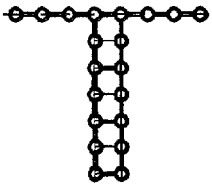
FIGURE 5d
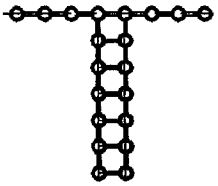
FIGURE 5e
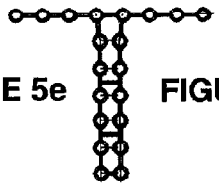
FIGURE 5f
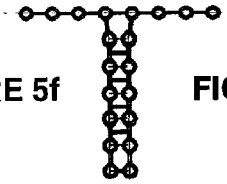
FIGURE 5g
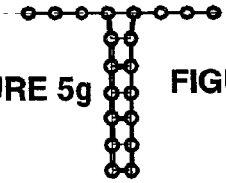
FIGURE 5h
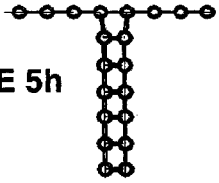
FIGURE 5i
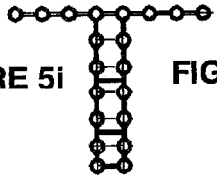
FIGURE 5j
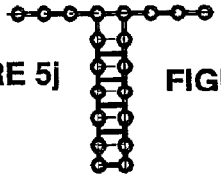
FIGURE 5k
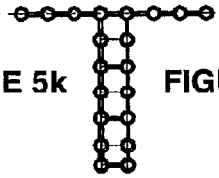
FIGURE 5l
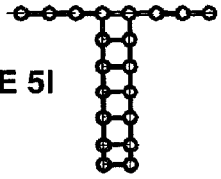
FIGURE 5m
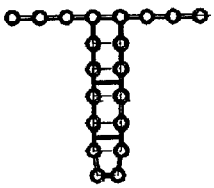
FIGURE 5n
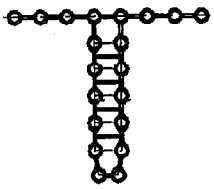
FIGURE 5o
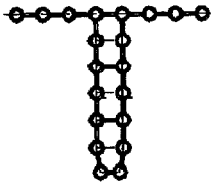
FIGURE 5p
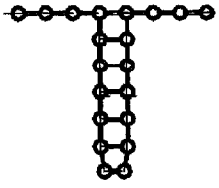
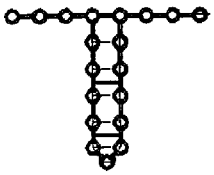
FIGURE 5q
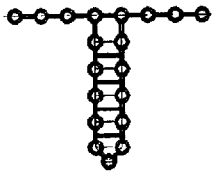
FIGURE 5r
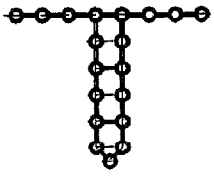
FIGURE 5s
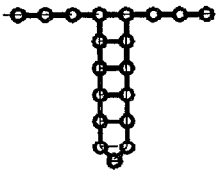
FIGURE 5t 5
4a
4a
4a
4a
10a

DOUBLE WALL EXTENSION

BACKGROUND OF THE INVENTION

The present invention concerns fluidised bed reactors such as boiler combustion chambers. These reactors consist of a combustion chamber usually made up of tubed membrane walls cooled by a coolant fluid such as a water/steam mixture.

The part of the combustion chamber that can be rectangular is determined by the speed at which the combustion fumes ascend under correct working conditions. Since the periphery of the combustion chamber is fixed, the flow rate of the coolant fluid that can circulate within the wall tubes will be determined according to the diameter and the distance chosen for the said tubes. The height of the combustion chamber allows the thermal exchange surface of the four walls to be obtained, however this height must be optimised with the aim of reducing the height and thus the costs of installation but also in such a way that the time necessary for the chemical reactions between the particles takes place within the combustion chamber.

According to the size of the installation and the required steam cycle, the combustion chamber section forms a perimeter that may be insufficient for the installation into the walls of the tubes in parallel, necessary for the circulation of the quantity of coolant fluid. In addition, the requirement for thermal exchange may necessitate the installation of additional exchange surfaces in the combustion chamber.

One solution already known consists in adding single wall extension panels into the combustion chamber, such as described in patent FR 2 712 378 of the applicant. These extension panels are vertical, tubed and have membranes, and are welded to the periphery walls and fed with coolant fluid in parallel or in series with the walls forming the exterior envelope of the combustion chamber.

However, these single wall extension panels are limited in height, in the number of tubes of which they are composed and in quantity due to the minimum distance required between them, for reasons of stress and erosion by the ashes that circulate within the combustion chamber. The additional exchange surface is thus limited.

These single wall extension panels are heated on both sides by the ashes and the gases which, in certain cases, may result in overheating of the tubes if there should be an imbalance between the thermal flux received from the fluidised bed circulating within the combustion chamber and the flow of coolant fluid that ensures cooling of the tubes.

Another solution could be to increase the height of the combustion chamber in order to increase the exchange surface of the walls without adding internal extensions, but this solution is costly since the overall height of the installation is increased.

SUMMARY OF THE INVENTION

The present invention proposes a solution to the problem of insufficient exchange surfaces in the combustion chamber at lower cost and without increasing the height of the installation.

The fluidised bed reactor according to the invention is made up of tubed membrane walls cooled by a coolant fluid, these walls encircling a combustion chamber and comprising tubed extension panels through which flows a coolant fluid by single pass forced circulation. According to the invention the extension panels are paired two by two.

The coolant fluid that flows in this way within the tubes in the walls and in the tubed extensions allows balancing of the thermal flux received from the fluidised bed circulating in the combustion chamber. The circulation is single pass, which means that all the tubes in the combustion chamber and the extensions have fluid flowing in parallel. Single pass circulation avoids long connecting pipework between the extension panels and the walls of the combustion chamber (at the top for exit from the panels and at the bottom for entry into the walls of the combustion chamber). Thus, all that remains are feed pipes at the bottom and emission pipes at the top for the panels and the walls of the combustion chamber.

The invention allows just one side of each extension to be heated by the fluidised bed circulating in the combustion chamber, which allows a lower flow rate of coolant fluid since the second side of each of the extension panels paired in this way is not in contact with the ashes and the hot gases that make up the fluidised bed circulating in the combustion chamber, which avoids forms of heat transfer which can damage the mechanical behaviour of the tubes. On the other hand, by doubling the number of tubes in each extension panel, the part through which the coolant fluid circulating in these extensions passes increases in comparison to single extensions and the exchange surface is increased. These double wall extensions have better mechanical behaviour, it is possible to make them bigger.

According to another arrangement, the extension panels are attached to the walls of the combustion chamber. This allows rigidity to be improved and panel deformation to be minimised, something which could give rise to erosion caused by solids descending as a layer along the walls.

According to one variation, the extension panels go from the top of the reactor to a maximum height equal to 75% of the height of the combustion chamber. This is because it is in the upper area of the combustion chamber that the temperature is at its highest and that the risks of erosion are at a minimum since the concentrations of solids decrease with height and the gaseous atmosphere in the upper part of the combustion chamber is fully oxidising.

According to another variation, the bottom of the combustion chamber is in the form of a divided combustion chamber, called a "pant leg". This shape allows the introduction of combustion air into the central area of the combustion chamber, in order to distribution this air well over the whole area of the combustion chamber.

According to a particular arrangement, the coolant fluid is in the liquid and/or gaseous phase according to the working thermal load of the boiler. The fluid is liquid when the load is low and gaseous when it is high.

According to a particular arrangement, the coolant fluid is water.

According to one variation, the extension panels form enclosures that include openings. In the case of an escape of coolant fluid from the tubes, these openings allow an increase in pressure inside the enclosure to be avoided.

According to a particular arrangement, the extension panels are placed at least partly in the dense layer of solids. This is because it is within this area of high concentration of solids that thermal exchanges are at their highest.

According to another arrangement, the tubes that make up the extension panels are of different dimensions to those of the wall tubes.

According to an initial variation, the distance between two tubes making up the extension panels is fixed. This simplifies manufacture of the panels.

According to a second variation, the distance between two tubes making up the extension panels is variable. This allows optimisation of the thermodynamic behaviour of the said panels and the temperature thresholds of the metal not to be exceeded.

According to a third variation, the distance between two twin extension panels is equal to the distance between two tubes of the combustion chamber screening wall. In this way, manufacture of the assembly is simplified.

According to another arrangement, the tubes in the extension panels have coolant fluid flowing through them in series with the periphery walls. This choice depends on the steam cycles and the thermal forces to be exchanged in the extension panels.

According to another particular arrangement, the extension panels are arranged on the partition walls that divide up the combustion chamber. This allows an increase in the number of extension panels and thus an increase in the number of exchange surfaces at lower cost.

According to a variation, the partition walls go from the top of the reactor to a maximum height equal to 75% of the height of the combustion chamber. These double partition walls may be of the separated or close type according to the access rules for maintenance between the walls.

BRIEF DESCRIPTION OF THE DRAWINGS

It will be easier to understand the invention by reading the following description which is given solely by way of example and which has been drawn up by referring to the attached illustrations, where:

- FIGS. 5*a* to 5*t* are horizontal cross-section views that illustrate different types of extension panels possible,
- FIGS. 1*a* to 11*d* are vertical cross-section views of installation examples of double partition walls,
- FIGS. 2*a* to 12*c* are perspective views of installation examples of double partition walls.

DETAILED DESCRIPTION OF THE PREFERRED EMBODIMENT

Figure 1:
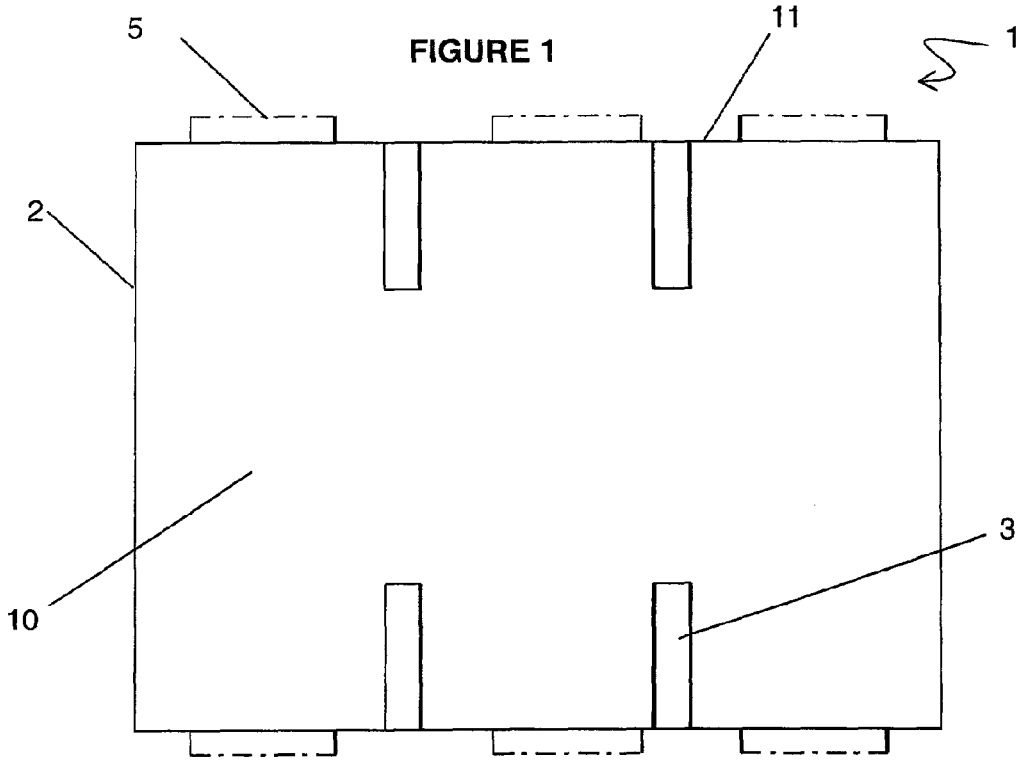
- FIGS. 1, 2, 3 and 4 show horizontal cross-section views of reactors equipped with extension panels according to the invention.
Figure 2:
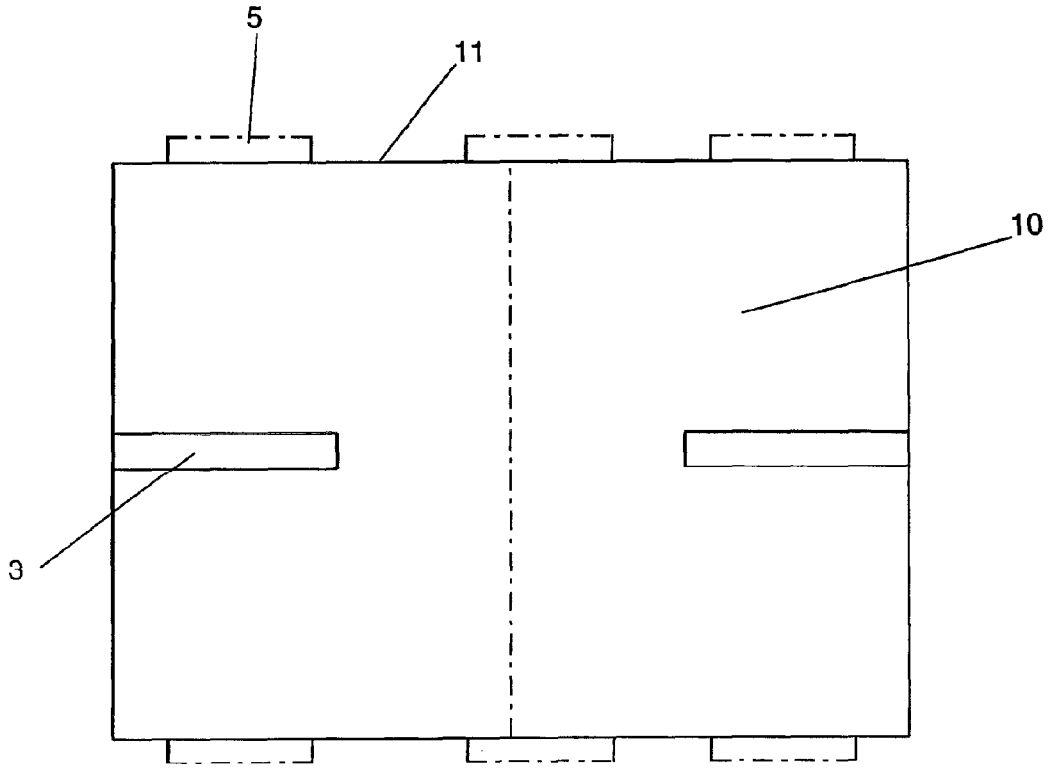
Figure 3:
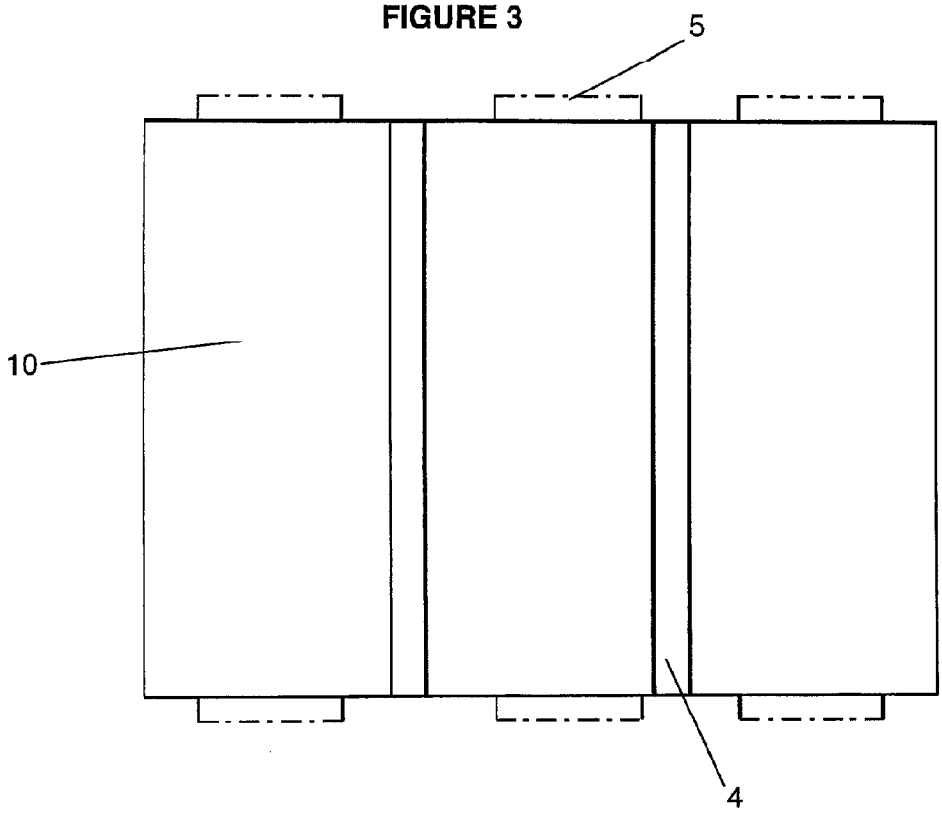
Figure 3A:
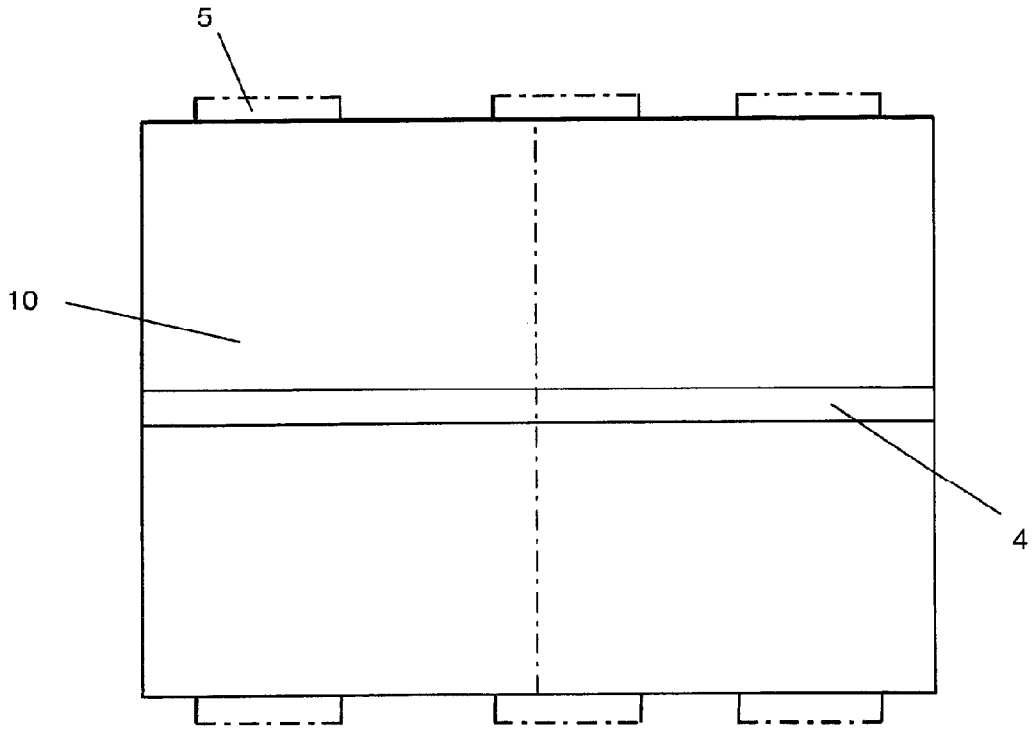
Figure 4:
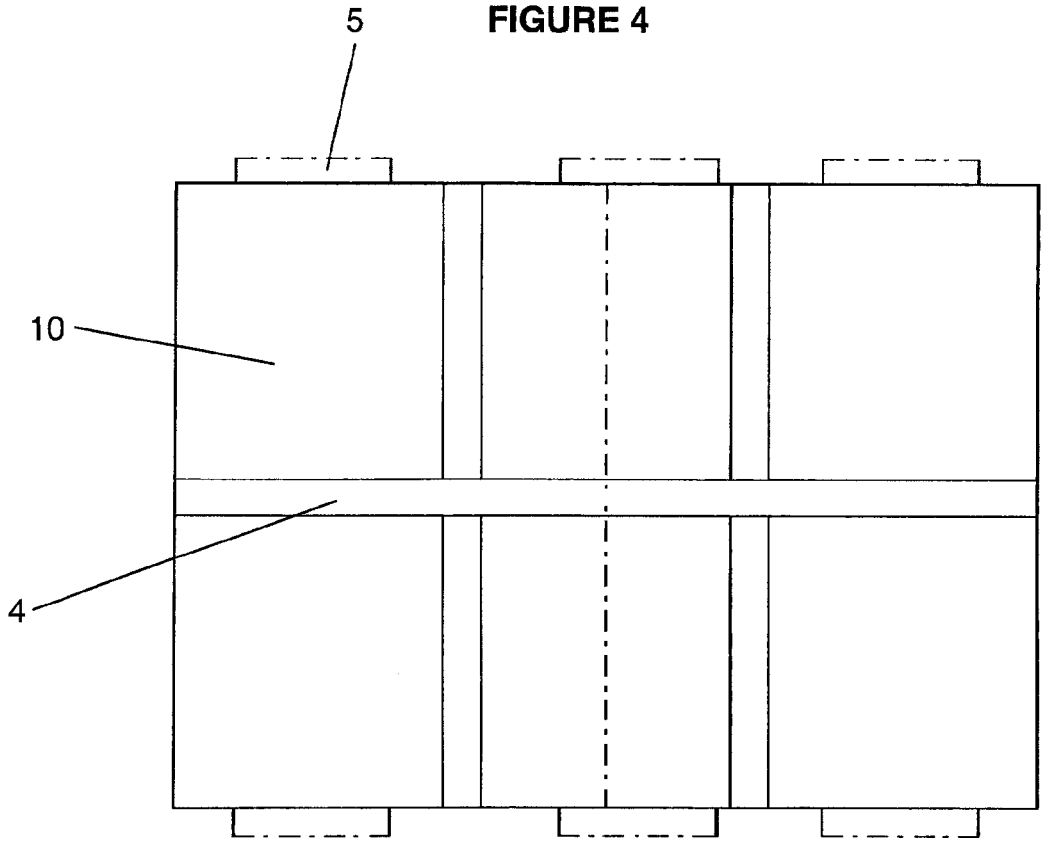

FIGS. 1 to 4 depict a fluidised bed reactor 1 made up of tubed membrane walls 2 cooled by a coolant fluid surrounding a combustion chamber 10. The walls 2 comprise tubed extensions 3. The wall 11 includes openings 5 that communicate with the cyclones (not depicted). These extensions may be arranged perpendicularly on the wall 11, as in FIG. 1, or parallel to the wall 11, as in FIG. 2, or form combustion chamber 10 partition walls 4, as in FIG 3, where the combustion chamber 10 is divided into three and FIG. 3*a* where the combustion chamber is divided into two. In FIG. 4, the combustion chamber 10 is divided into six.

FIG. 5 depict the different types of possible extension panels. This set of figures shows the variety of possible constructions that depend on the requirements for exchange surfaces and thermodynamic behaviour criteria, which themselves depend on the conditions of the gaseous liquid or water steam cycle. In particular, FIGS. 5*a* to 5*t* have only one tube at the end in order to reduce the thermal flux received by the tube and the end fin.

Figure 6:
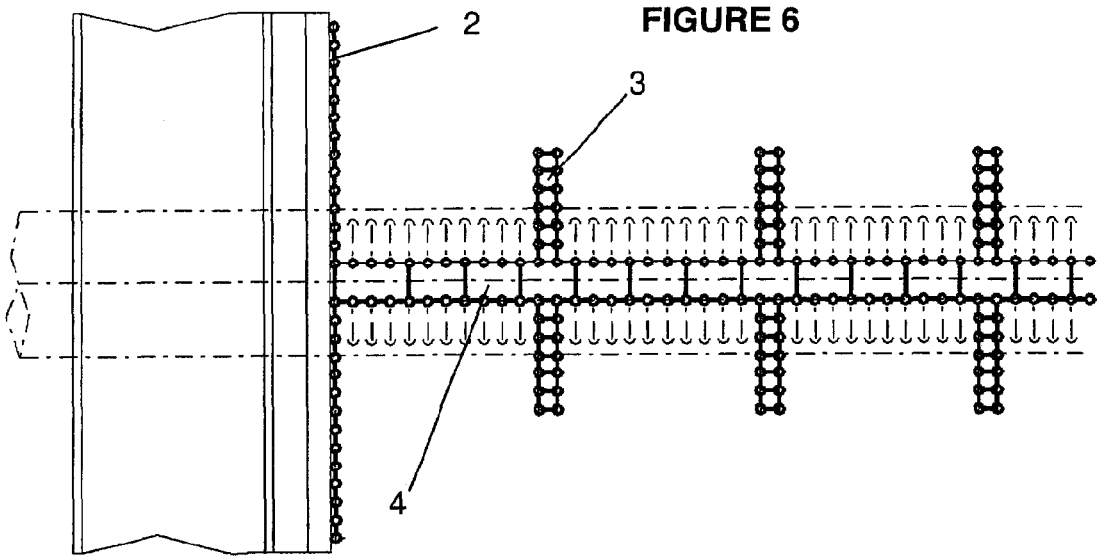
- FIG. 6 is a horizontal cross-section view of double extension panels on a double partition wall of the close type.

FIG 6 depicts details of a double partition wall 4 of the close type on which extension panels 3 have been arranged.

Figure 7:
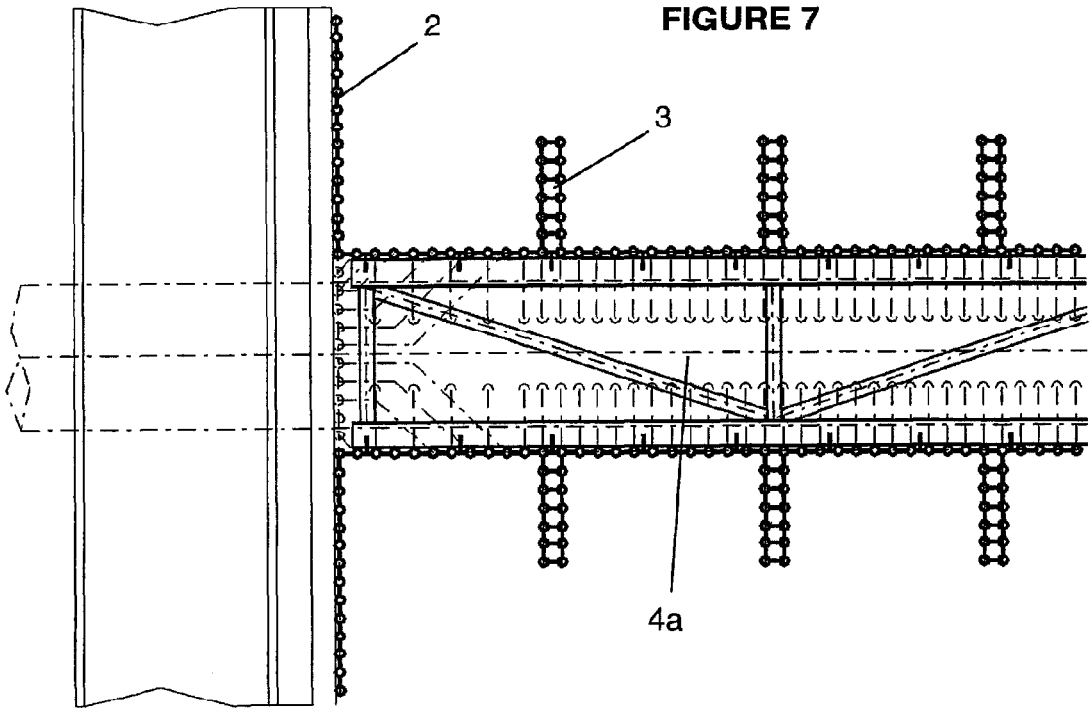
- FIG. 7 is a horizontal cross-section view of double extension panels on a double partition wall of the separated type.
Figure 8:
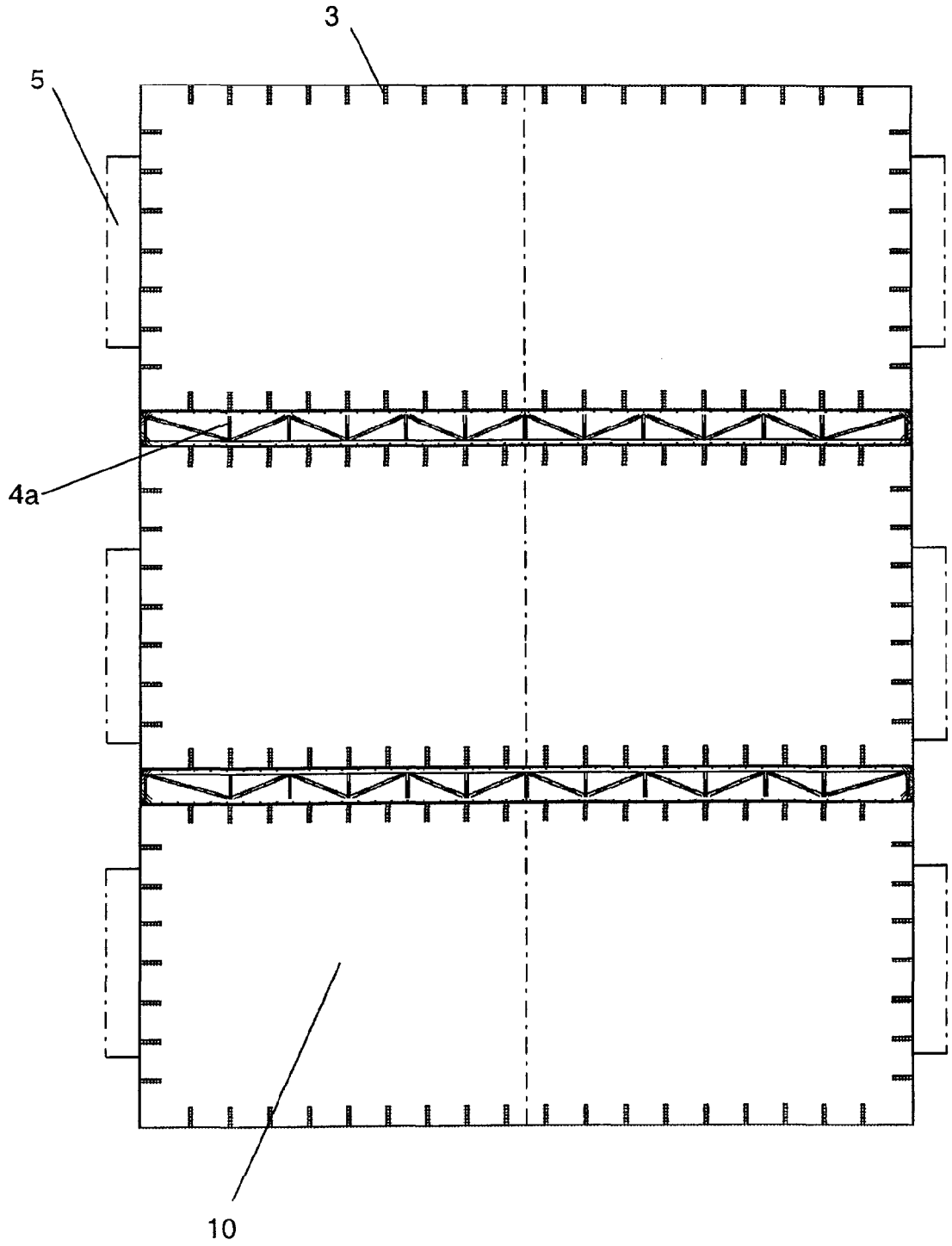
- FIG. 8 is a horizontal cross-section view of an example of a combustion chamber comprising two double partition walls and double extension panels on the periphery walls and the partition walls.

FIG. 7 and 8 depict a partition wall 4*a* of the separated type on which extension panels 3 have been arranged. FIG. 7 depicts the details of the wall 4*a*.

Figure 9:
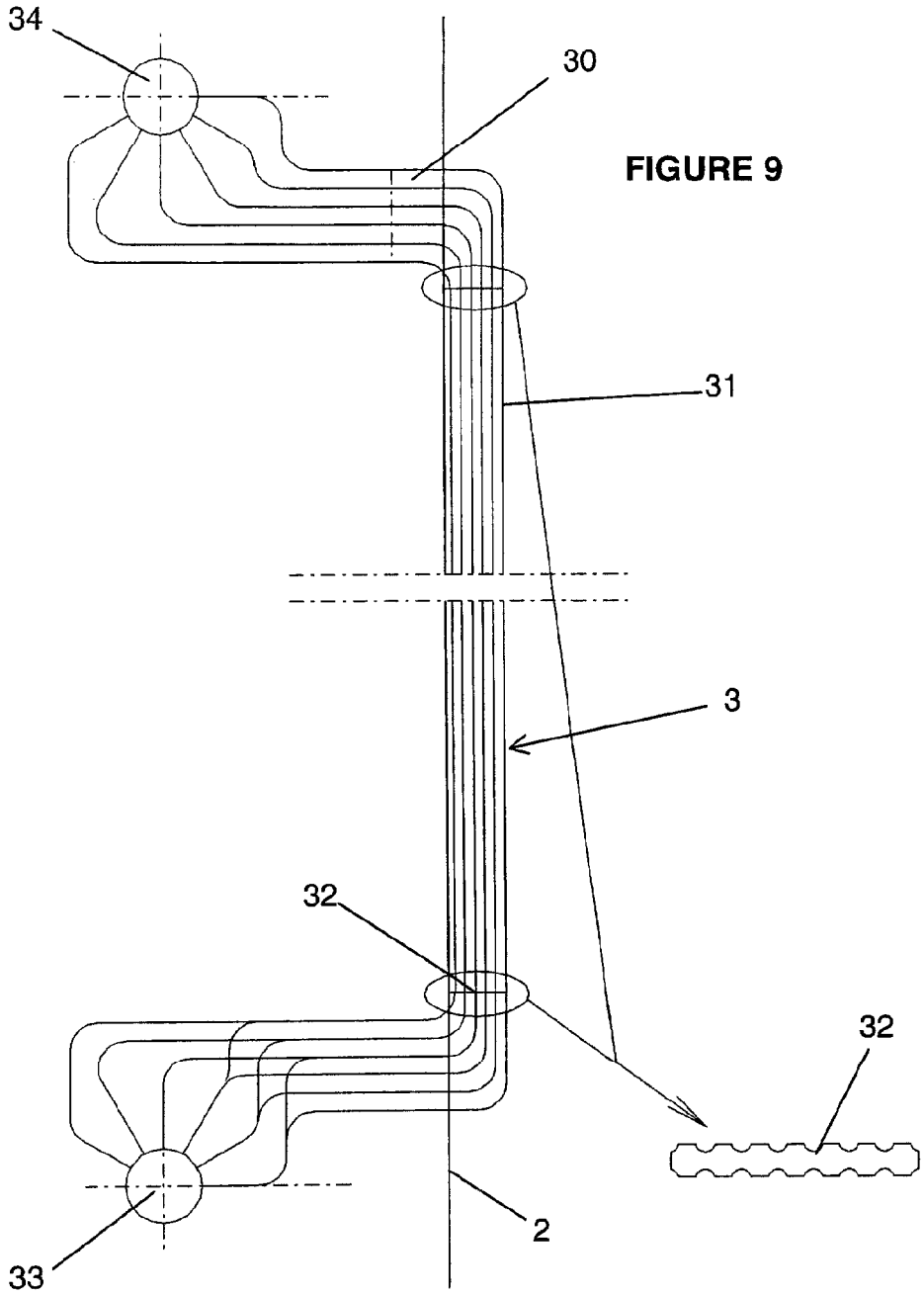
- FIG. 9 is a vertical cross-section view of a double extension.

By way of example, extension panel 3 is fed by a distribution circuit 30, it comprises tubes 31 which are held spaced apart by a curved sealing fin 32. The coolant fluid circulates in the tubes 31 of the entrance manifold 33 towards the exit manifold 34 (cf. FIG. 9).

Figure 10:
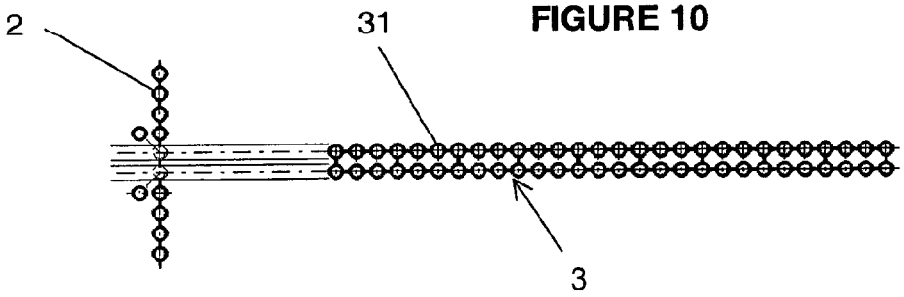
- FIG. 10 is a horizontal cross-section view of a double extension.

Extension 3 depicted in FIG. 10 is a cross-section view from the top. It is made up of tubes 31.

Figures 11A, 11B, 11C, 11D:
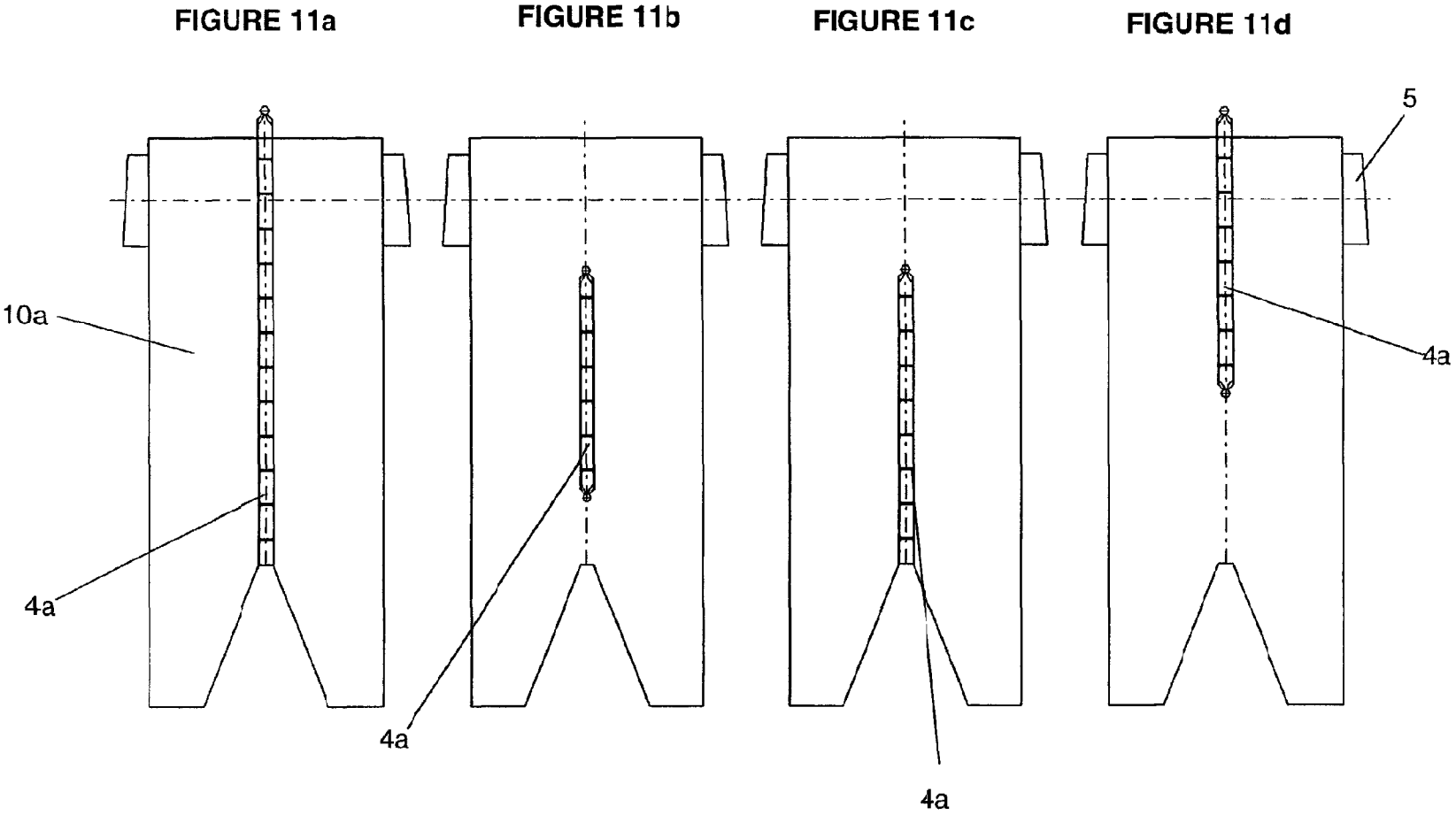
Figure 12A:
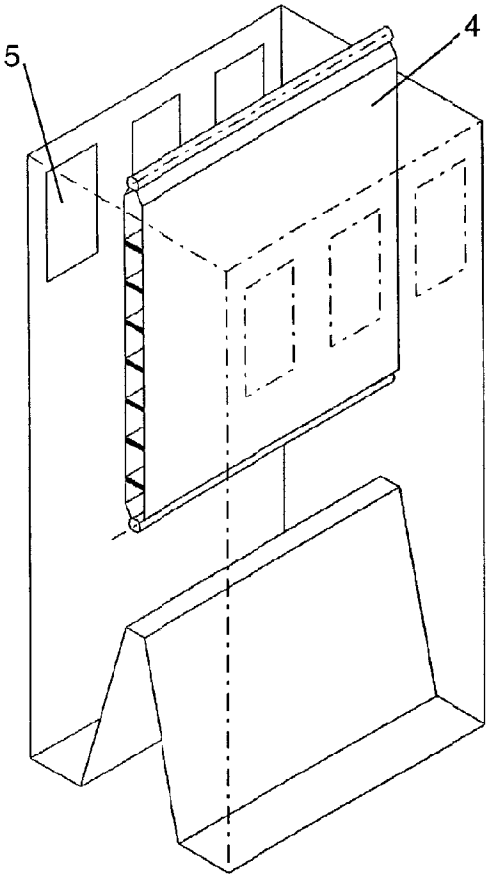

The double partition wall 4 may be arranged in a different manner: either over the whole of the height as in FIG. 11*a*, or only in the central portion as in FIG. 11*b*, or up to an intermediate height as in FIG. 11*c*, or from the ceiling up to an intermediate height as in FIG. 11*d* or FIG. 12*a*.

Figure 12B:
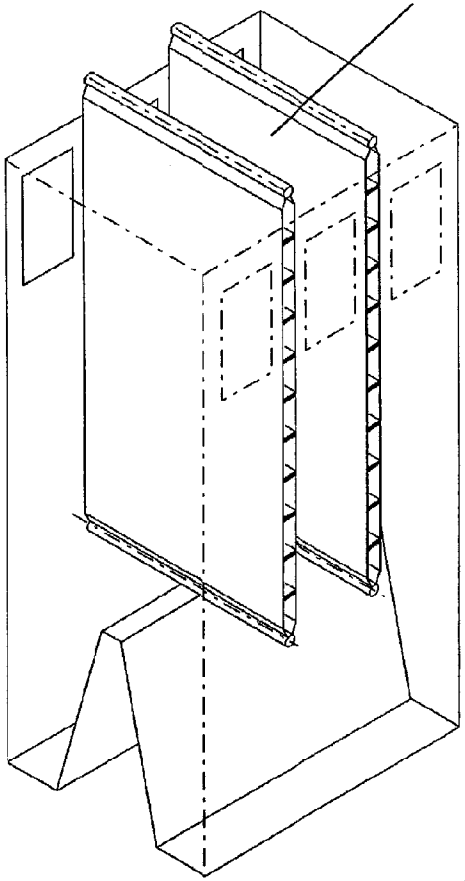
Figure 12C:
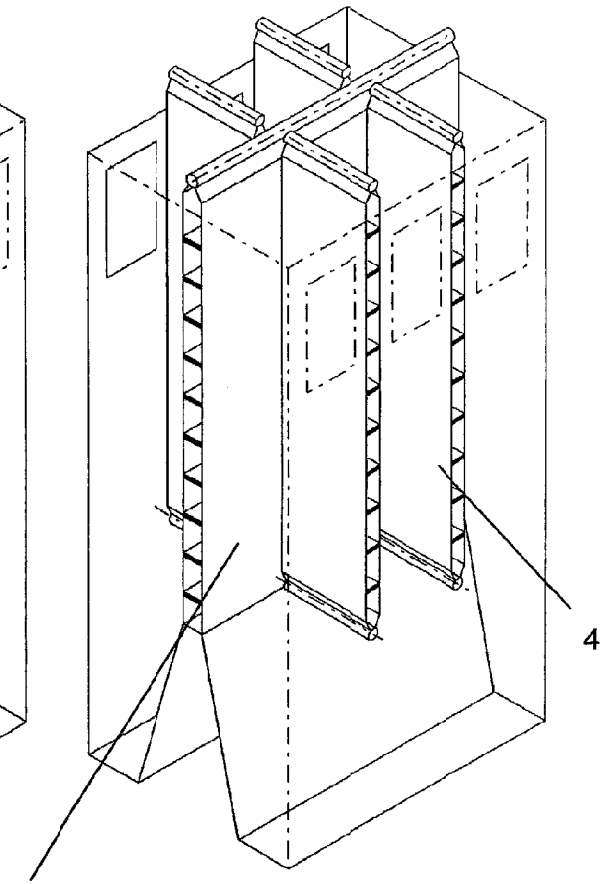
Figure 13:
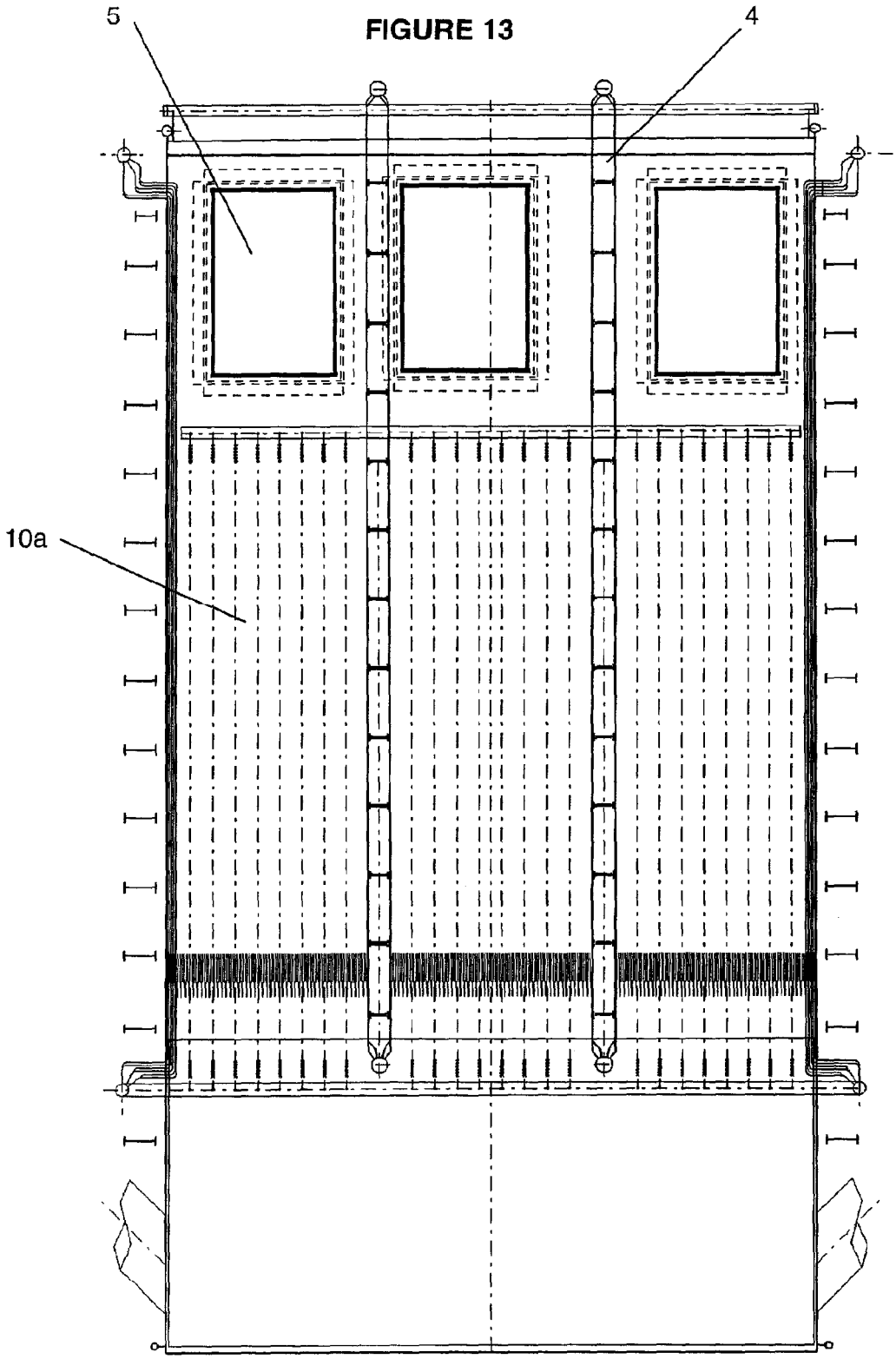
- FIG. 13 is a vertical cross-section view of an installation example of double partition walls.

It is also possible to place several double partition walls 4 parallel as in FIGS. 12*b* and 13, or which are intersected as in FIG. 12*c*. It is thus possible to separate the combustion chamber 10 into several combustion sub-chambers 10*a*. Thus, it is possible to get a combustion chamber with six cyclones 5 and two parallel double partition walls 4 which divide the combustion chamber 10 into three combustion sub-chambers 10*a*, each one opening out onto two cyclones 5.

Figures 14A, 14B, 14C, 14D, 14E, 14F, 14G, 14H, 14I, 14J, 14K, 14L:
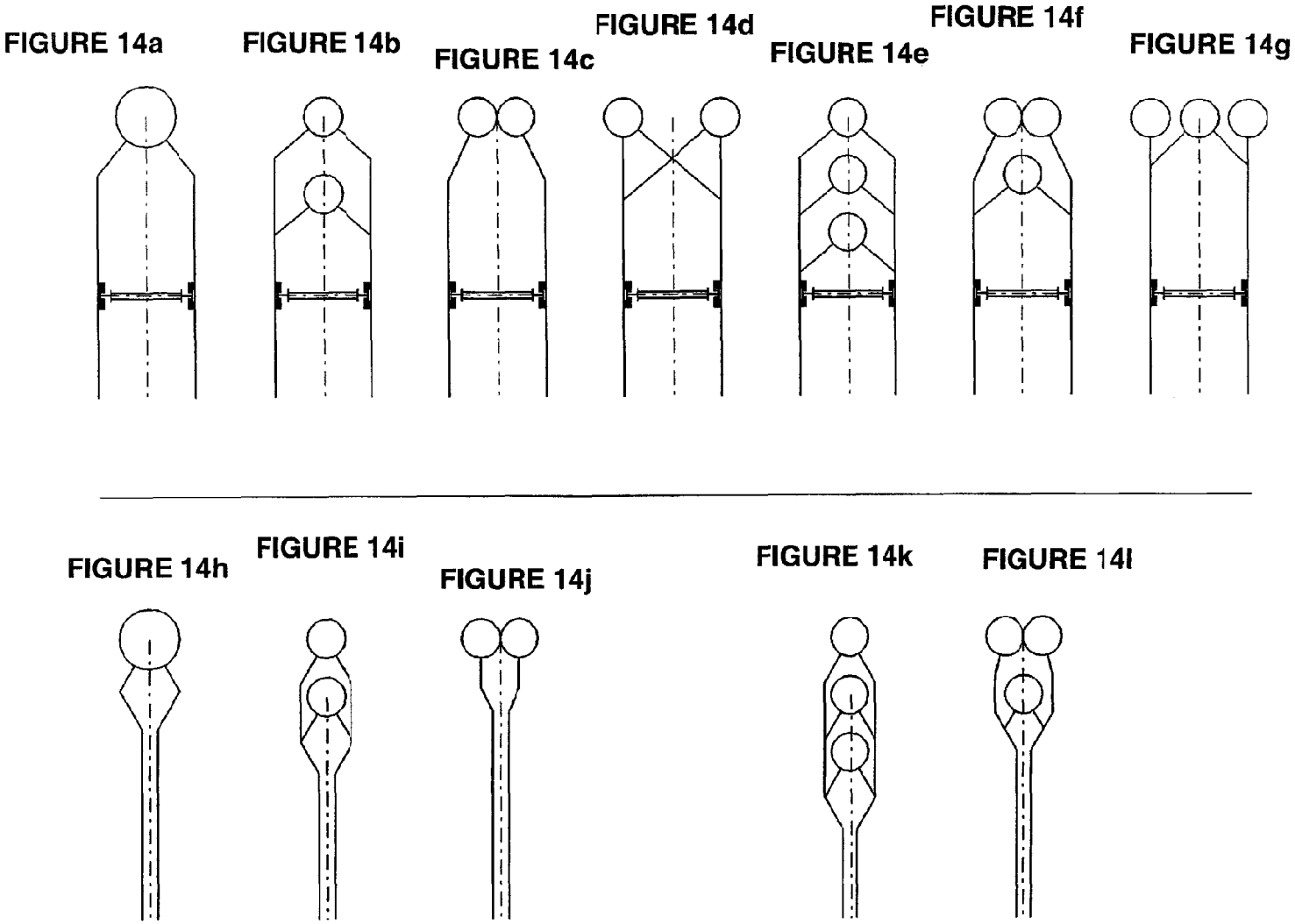
- FIGS. 14*a* to 14*l* are examples of different positions for entry and exit manifolds for the double partition walls.

FIG. 14 depicts the different arrangements of the entry and exit manifolds possible for double partition walls with walls of the close type (FIGS. 14*h* to 14*l*) or of the separated type (14*a* to 14*g*). The choice of different arrangements for manifolds depends on the size of the partition walls and on optimisation of the distribution of coolant fluid in these walls.

The examples given above may be extended to non-rectangular section combustion chambers, as for example square, hexagonal, octagonal or circular sections.

The invention claimed is:

1. A fluidized bed reactor having a top, said fluidized bed reactor comprising:

a fluidized bed;

tubed membrane walls cooled by a coolant fluid, said tubed membrane walls defining side walls of a combustion chamber having a bottom;

at least one partition wall extending between parallel tubed membrane walls to divide the combustion chamber; and tubed extension panels extending within the combustion chamber through which flows a coolant fluid by single pass forced circulation, said extension panels are paired to form a double wall extension, the tubed extension panels including tubes and membranes each tube is contacted by a membrane, wherein the tubed membrane walls and the tubed extension panels are exposed to heated material of the fluidized bed on only one side, wherein said extension panels are arranged on and extend from the at least one partition wall to a point within an inner area of the combustion chamber between the partition wall and one of the parallel tubed membrane walls, and wherein the at least one partition wall is a double wall partition formed of tubed panels paired together.

2. The fluidized bed reactor as claimed in claim 1 wherein said extension panels are attached to said tubed membrane walls of the fluidized bed reactor.

3. The fluidized bed reactor as claimed in claim 2 wherein said extension panels extend from said top of the fluidized bed reactor downward to a height greater than approximately 75% of the height of said combustion chamber.

4. The fluidized bed reactor as claimed in claim 1 wherein said bottom of said combustion chamber is in the form of a divided combustion chamber.

5. The fluidized bed reactor as claimed in claim 1 wherein said coolant fluid is in the liquid and/or gaseous phase according to the working thermal load of the fluidized bed reactor.

6. The fluidized bed reactor as claimed in claim 5 wherein said coolant fluid is water.

7. The fluidized bed reactor as claimed in claim 1 wherein said extension panels form enclosures containing openings.

8. The fluidized bed reactor as claimed in claim 1 wherein said extension panels are positioned partly at least in a dense layer of solids.

9. The fluidized bed reactor as claimed in claim 1 wherein tubes make up said extension panels, and said tubes are of dimensions different than those of the tubed membrane walls.

10. The fluidized bed reactor as claimed in claim 9 wherein the distance between two of said tubes making up different extension panels is the same.

11. The fluidized bed reactor as claimed in claim 9 wherein the distance between two of said tubes making up different extension panels is different.

12. The fluidized bed reactor as claimed in claim 9 wherein the distance between two extension panels of the double extension wall is substantially equal to the distance between two of said tubes of the tubed membrane wall.

13. The fluidized bed reactor as claimed in claim 9 wherein the tubes of said extension panels have coolant fluid flowing through them in series with said tubed membrane walls.

14. The fluidized bed reactor as claimed in claim 1 wherein said at least one partition wall extend downward from said top of the fluidized bed reactor to a height greater than approximately 75% of the height of said combustion chamber.

15. The fluidized bed reactor as claimed in claimed 1, wherein the double wall extension has a tube disposed at the end thereof.

16. The fluidized bed reactor as claimed in claim 1, wherein the at least one partition wall extends substantially the whole height of the combustion chamber.

17. The fluidized bed reactor as claimed in claim 1, wherein the at least one partition wall extends only in the central portion of the combustion chamber.

18. The fluidized bed reactor as claimed in claim 1, wherein the at least one partition wall extends up to an intermediate height of the combustion chamber.

19. The fluidized bed reactor as claimed in claim 1, wherein the partition wall extends only from the top to an intermediate height of the combustion chamber.

20. The fluidized bed reactor as claimed in claim 1, where the fluidized bed reactor comprises a divided combustion chamber; each combustion chamber being termed a pant leg.

* * * * *